US010791814B2

(12) United States Patent
Masterson

(10) Patent No.: US 10,791,814 B2
(45) Date of Patent: Oct. 6, 2020

(54) HAIR DRYING SYSTEM AND METHOD

(71) Applicant: Cynthia Masterson, Seattle, WA (US)

(72) Inventor: Cynthia Masterson, Seattle, WA (US)

( * ) Notice: Subject to any disclaimer, the term of this patent is extended or adjusted under 35 U.S.C. 154(b) by 51 days.

(21) Appl. No.: 15/968,306

(22) Filed: May 1, 2018

(65) Prior Publication Data

US 2018/0310686 A1 Nov. 1, 2018

Related U.S. Application Data

(60) Provisional application No. 62/492,682, filed on May 1, 2017.

(51) Int. Cl.
*A45D 20/12* (2006.01)

(52) U.S. Cl.
CPC ..... *A45D 20/122* (2013.01); *A45D 20/12* (2013.01)

(58) Field of Classification Search
CPC .... A45D 20/122; A45D 20/12; A45D 20/128; A45D 20/10; A45D 20/08
USPC ..... 34/96–98, 283; 219/222; 2/159
See application file for complete search history.

(56) References Cited

U.S. PATENT DOCUMENTS 3,574,885 A * 4/1971 Jones ..... A01K 13/002 15/393
4,620,374 A * 11/1986 Patterson ..... A45D 20/00 132/212
4,692,594 A 9/1987 Martin
5,526,578 A * 6/1996 Iyer ..... A45D 20/10 239/443
5,826,595 A 10/1998 Ramm et al.
5,944,031 A * 8/1999 Farley ..... A45D 20/00 132/120
8,459,273 B2 6/2013 Da Silva
2011/0197338 A1 8/2011 Coyne
2017/0231359 A1 8/2017 Taylor

FOREIGN PATENT DOCUMENTS

CN 2935935 8/2007
DE 20101555 4/2001
WO 2002060296 8/2002

OTHER PUBLICATIONS

Cooperative Patent Classification, "A45D—Hairdressing or Shaving Equipment; Manicuring or Other Cosmetic Treatment," Feb. 2017.

* cited by examiner

*Primary Examiner* — John P McCormack
(74) *Attorney, Agent, or Firm* — Davis Wright Tremaine LLP

(57) ABSTRACT

A drying system comprising a glove assembly having a first glove body defining a first glove cavity and a first glove body opening at a first glove body base end that communicates with the first glove cavity; and a second glove body defining a second glove cavity and a second glove body opening at a second glove body base end that communicates with the second glove cavity. The drying system further includes an elongated duct having a first and second duct end and defining a duct cavity extending between the first and second duct ends, the duct further defining first and second duct openings at the respective first and second duct ends, the second duct end coupled to the first glove body base end with the duct cavity communicating with the first glove body.

20 Claims, 10 Drawing Sheets

HAIR DRYING SYSTEM AND METHOD

CROSS-REFERENCE TO RELATED APPLICATIONS

This application is a non-provisional of and claims the benefit of U.S. Provisional Application No. 62/492,682 filed May 1, 2017, entitled "HAIR DRYING SYSTEM AND METHOD" which application is hereby incorporated herein by reference in its entirety and for all purposes.

Figure 1:
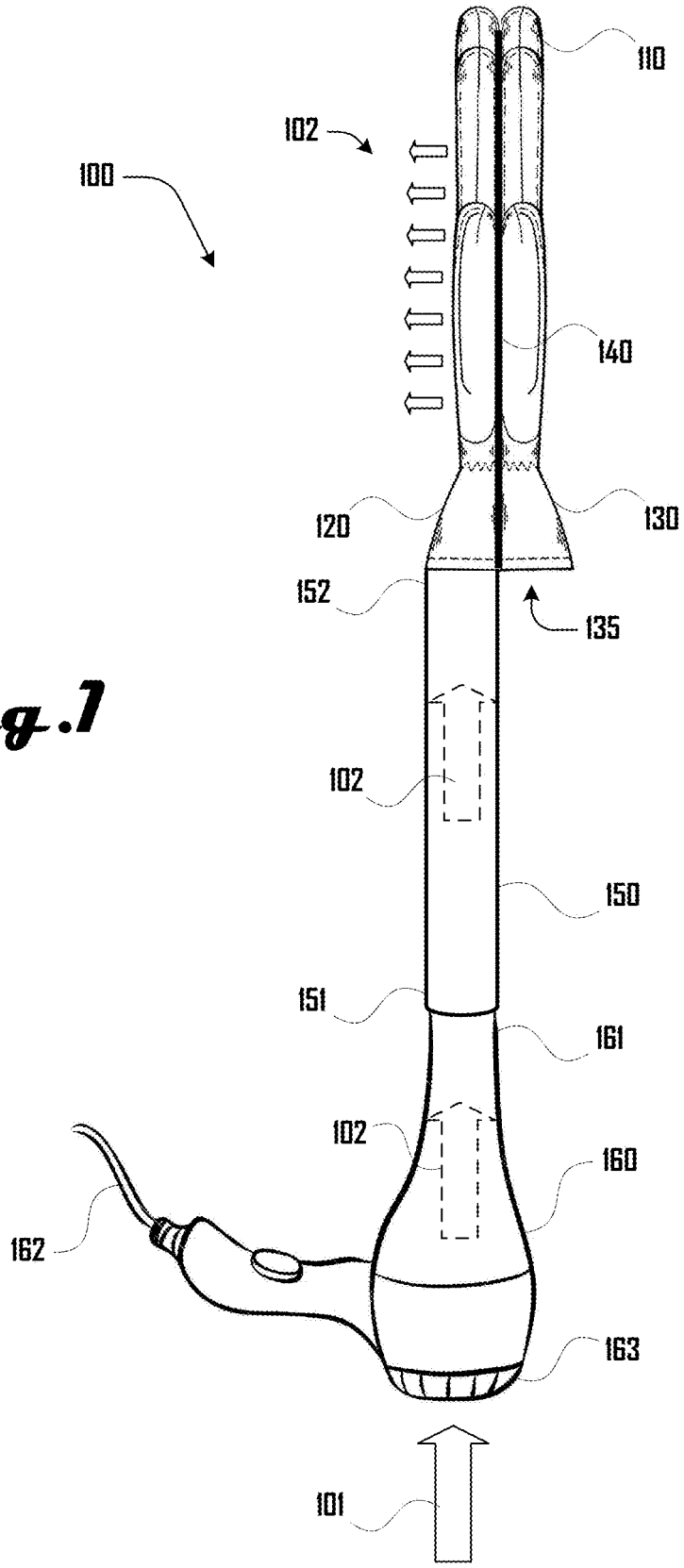
FIG. 1 is a side view of a hair drying system in accordance with one embodiment.

It should be noted that the figures are not drawn to scale and that elements of similar structures or functions are generally represented by like reference numerals for illustrative purposes throughout the figures. It also should be noted that the figures are only intended to facilitate the description of the preferred embodiments. The figures do not illustrate every aspect of the described embodiments and do not limit the scope of the present disclosure.

DETAILED DESCRIPTION OF THE PREFERRED EMBODIMENTS

Figure 2:
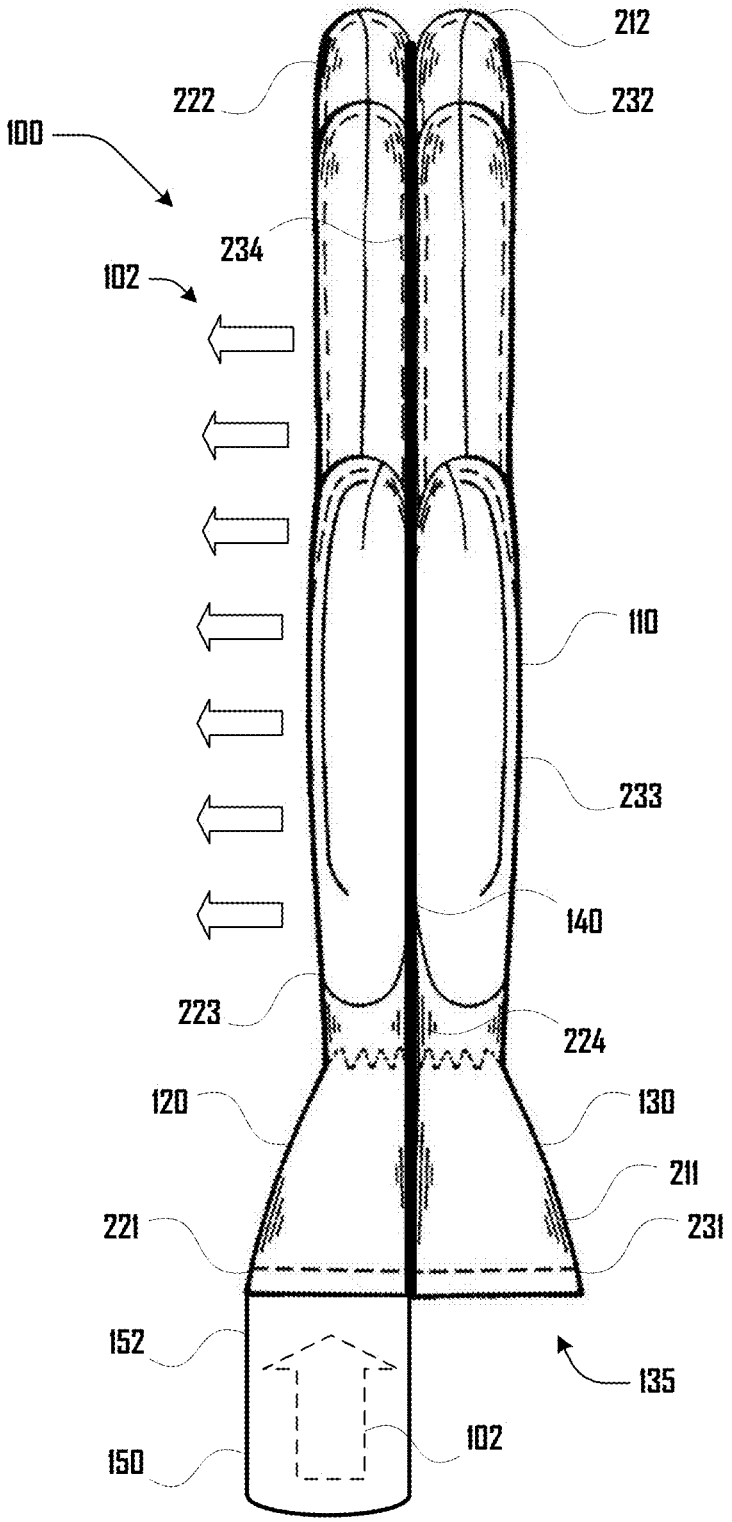
FIG. 2 is a close-up side view of a glove assembly of the hair drying system of FIG. 1.

FIG. 1 illustrates a side view of a hair drying system 100 in accordance with one embodiment and FIG. 2 illustrates a close-up side view of a glove assembly 110 of the hair drying system. As shown in FIG. 1, the hair drying system 100 can comprise a glove assembly 110 having a first and second glove body 120, 130 that are coupled along a seam 140. The first and second glove body 120, 130 define a respective first glove cavity 125 (see FIGS. 3*a*-4*b*) and a separate second glove cavity 135.

A duct 150 is coupled to the first glove body 120 at a second duct end 152, and coupled to a blower 160 at a first duct end 151. In this example embodiment, the blower 160 is shown comprising a hair dryer with the first duct end 151 coupled to a nozzle 161. The hair dryer is also shown comprising an electrical cord 162, which can be coupled to a power source that powers the blower 160.

As shown in the example of FIG. 1, the blower 160 can suck environmental air 101 into the blower 160 at an intake, and the environmental air 101 can be heated within the blower 160 to generate a flow of hot air 102 that is directed through the nozzle 161 of the blower 160 and into the duct 150. The flow of hot air 102 is forced into the first glove body 120 and expelled from the first glove body 120 via one or more suitable structure as described in more detail herein, including an air-permeable sheet, an air-port, a nozzle, or the like.

In various embodiments, the first end 151 of the duct 150 can be removably coupled to the nozzle 161 of the blower 160. For example, in some embodiments, in can be desirable for the glove assembly 110 and duct 150 to be configured to removably couple with a wide variety of commercially available blow dryers. More specifically, in embodiments where the glove assembly 110 and duct 150 are sold as a commercial product, it can be desirable for buyers of such a product to be able to couple the duct 150 to one or more dryer that the buyer already owns or that the buyer may later obtain.

Additionally, it can be desirable for the glove assembly 110 and duct 150 to be removably coupled to the hair dryer so that a user can still have the option to use a given hair dryer without the glove assembly 110 and duct 150; so that a user can use the glove assembly 110 and duct 150 on a different hair dryers; so that the user can travel with glove assembly 110 and duct 150; and the like.

Figure 7:
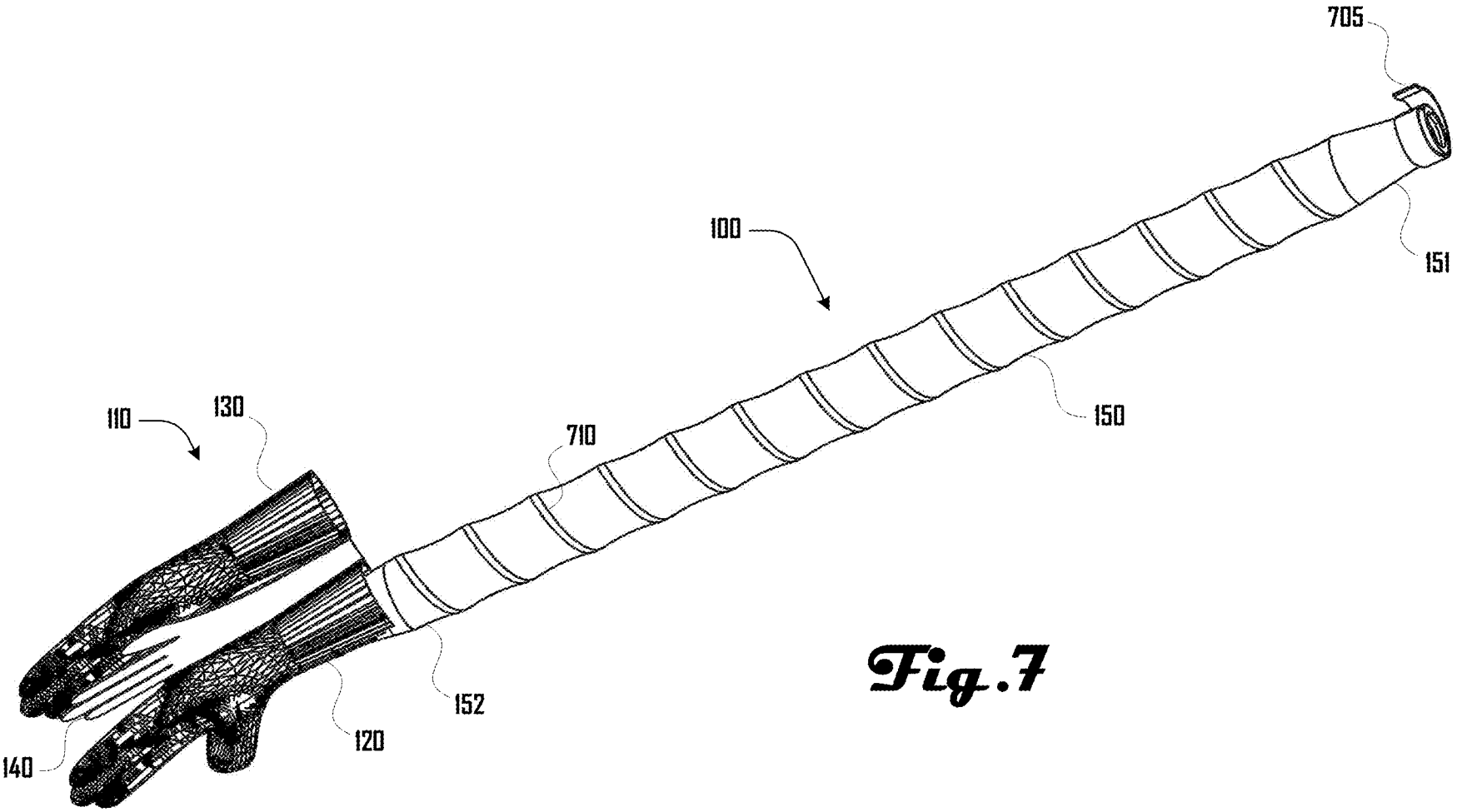
FIG. 7 is a side view of a hair drying system in accordance with one embodiment.
Figure 10B:
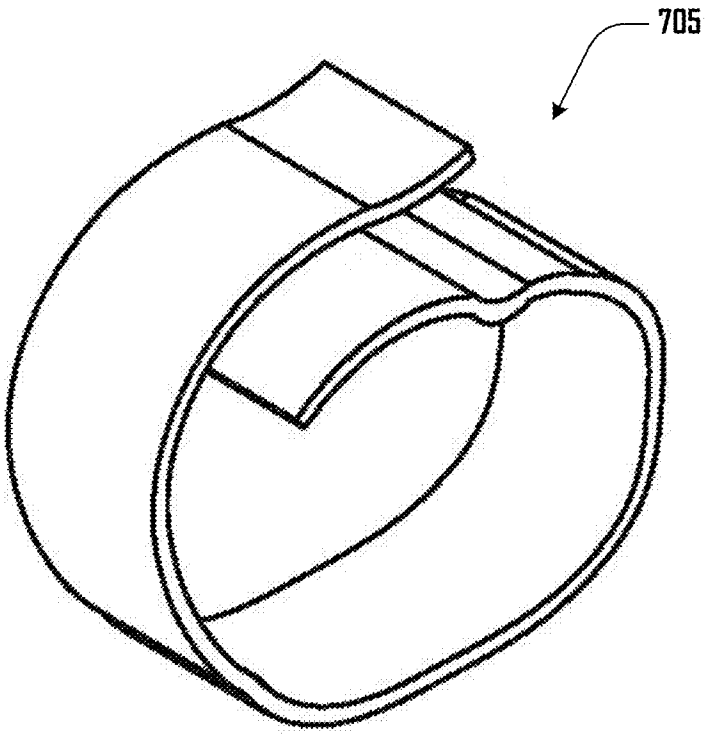
FIGS. 10*a* and 10*b* respectively illustrate side and perspective views of a loop strap in accordance with an embodiment.
Figure 10A:
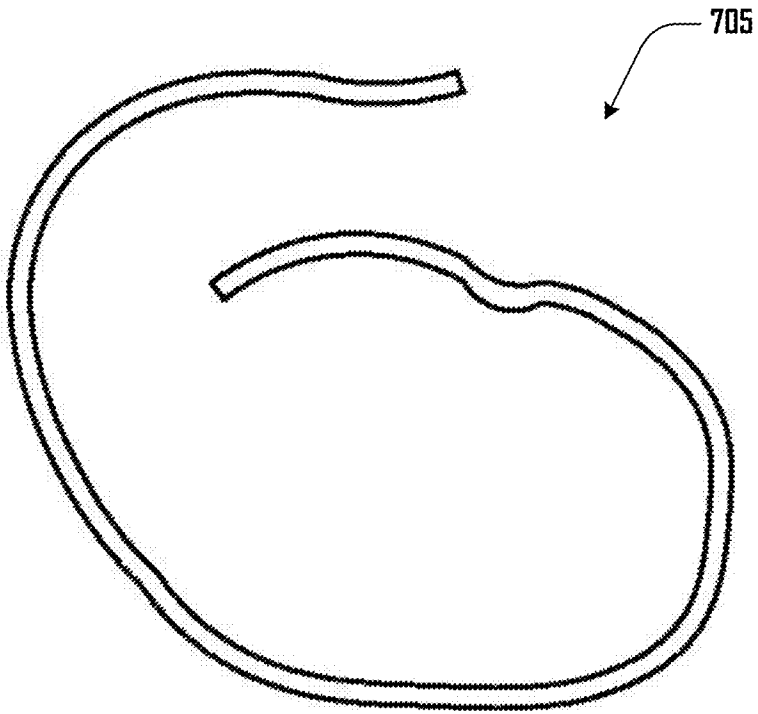

Accordingly, as discussed in more detail herein, in various embodiments the duct 150 can comprise suitable structures that allow the first end 151 of the duct 150 to be removably coupled to various sizes and/or shapes of nozzles 161 of a wide variety of commercially available hand-held hair dryers. For example, the first end 151 of the duct 150 can comprise one or more suitable elastic member, straps, cinches, clasps, clamps, friction coupling, adhesive, or the like. One preferred embodiment includes an elastic lip about the opening of the first end 151 and a silicone strap disposed as the first end 151 for coupling to different nozzles 161 of a blower 160. For example, FIGS. 10*a* and 10*b* respectively illustrate side and perspective views of a loop strap 705 in accordance with an embodiment, which can be coupled via hook and loop tape or the like. FIG. 7 illustrates a loop strap 705 coupled to the first end 151 of the duct 150.

While various embodiments of a hair drying system 100 can comprise a commercially available corded hair dryer removably coupled to the duct 150. In further embodiments, a blower 160 can be any suitable device configured to direct a flow of air or other suitable fluid. For example, in some embodiments, the blower 160 can comprise a heating and/or air conditioning system of a house, building, vehicle or the like. In such examples, the duct 150 can be coupled to an outlet port of such a system, which can provide air flow as described herein. Additionally, while various embodiments can include a blower 160 that generates a hot air flow, in further embodiments a blower 160 can be configured generate a cool flow of air or cool environmental air to generate a cool air flow. Additionally, in some embodiments, the blower 160 can be configured to not condition environmental air to generate an air flow. For example, in some embodiments, the blower 160 can comprise a fan or other non-conditioning air flow source.

Also, while various embodiments comprise a blower 160 that is removably coupled to a blower 160, further embodiments can be non-removably coupled to a blower 160 or coupled to a blower 160 with a limiting coupling structure that limits coupling of the duct 150 to one or a limited number of mating structures. Also, while various examples include corded blowers 160, further examples can comprise cordless blowers 160 that are powered in any suitable way. In various examples, the blower 160 can comprise a hand-held commercially available blow dryer. In other words, some embodiments can include a small portable commonly available hand-held blow dryer as opposed to large industrial blower systems that are not portable.

The duct 150 can be configured in any suitable way in accordance with various embodiments including being flexible and/or rigid in any desirable way. For example, in some embodiments, the duct 150 can comprise a flexible fabric tube having a support structure that can include a support coil 710 (see e.g., FIGS. 5, 6 and 7), support rings, or the like. The fabric can include any suitable sheet material, or textile, which can comprise a plastic, metal, natural fiber, or the like, which may or may not be air-permeable. In further embodiments, a support structure can be absent from the duct 150. In other embodiments, the duct 150 can comprise a ridged and inflexible body. Also, while various embodiments of the duct 150 comprise a cylindrical tube, further embodiments and include a duct having any suitable shape and size.

FIG. 2 is a close-up side view of the glove assembly 110 shown in FIG. 1, which illustrates the glove assembly 110 extending from an assembly base-end 211 to an assembly distal-end 212. The first and second glove bodies 120, 130 extend between respective base ends 221, 231 and distal ends 222, 232. The first and second glove bodies 120, 130 also respectively define external faces 223, 233, which oppose internal faces 224, 234.

As shown in this example, the internal faces 224, 234 can be coupled along a seam 140 that extends between the base and distal end 111, 112 of the glove assembly 110 and between the first and second glove bodies 120, 130. The seam 140 can comprise various suitable structures and/or be defined in various suitable ways. For example, in some embodiments, the first and second glove bodies 120, 130 can be coupled via an adhesive, weld, or the like. Additionally, in some embodiments, the seam 140 can comprise or be defined by various materials including a rigid planar sheet, a flexible planar sheet, hook and loop couplers, a heat-resistant material or the like. For example, FIG. 7 illustrates an example where a seam 140 comprises a planar material. In some examples, the seam can comprise a sheet of neoprene.

Additionally, some or all of the internal faces 224, 234 of the glove bodies 120, 130 can be coupled by or at the seam 140. In other words, some portions of the internal faces 224, 234 of the glove bodies 120, 130 are not coupled by or at the seam 140 in various embodiments. For example, in some embodiments, edges of the glove bodies 120, 130 may not be coupled by a seam 140.

Turning to FIGS. 3*a*, 3*b*, 4*a* and 4*b*, in various embodiments, the glove assembly 120 can comprise glove bodies 120, 130 configured and sized for a human hand, including a palm portion 310 with a single thumb member 320 and four finger members 330 extending from the palm portion 310. For example, in one preferred embodiment as shown in FIGS. 1 and 2, the glove bodies 120, 130 comprise mirrored palm portions 310, thumb members 320 and finger members 330 with one or more seam 140 coupling the glove bodies 120, 130 along the respective internal faces 224, 234 of the palm portions 310, thumb members 320 and finger members 330.

However, in some embodiments, some portions of the glove bodies 120, 130 may not be coupled by a seam 140. For example, in some embodiments one or more of the thumb members 320 or finger members 330 may not be coupled by a seam 140. Additionally, in further embodiments, some or all of the palm portions 310 may not be coupled by a seam 140.

Also, while preferred embodiments shown herein illustrate glove bodies 120, 130 having separate portions corresponding to a thumb and four fingers of a human hand (i.e., the thumb portion 320 and finger portions 330), further embodiments can be configured for a human hand, but with fewer than five separate portions. For example, in one embodiment, the glove bodies 120, 130 can define a mitten having a single thumb member 320 and a single finger member sized such that four fingers can reside within the single finger member.

Figure 8A:
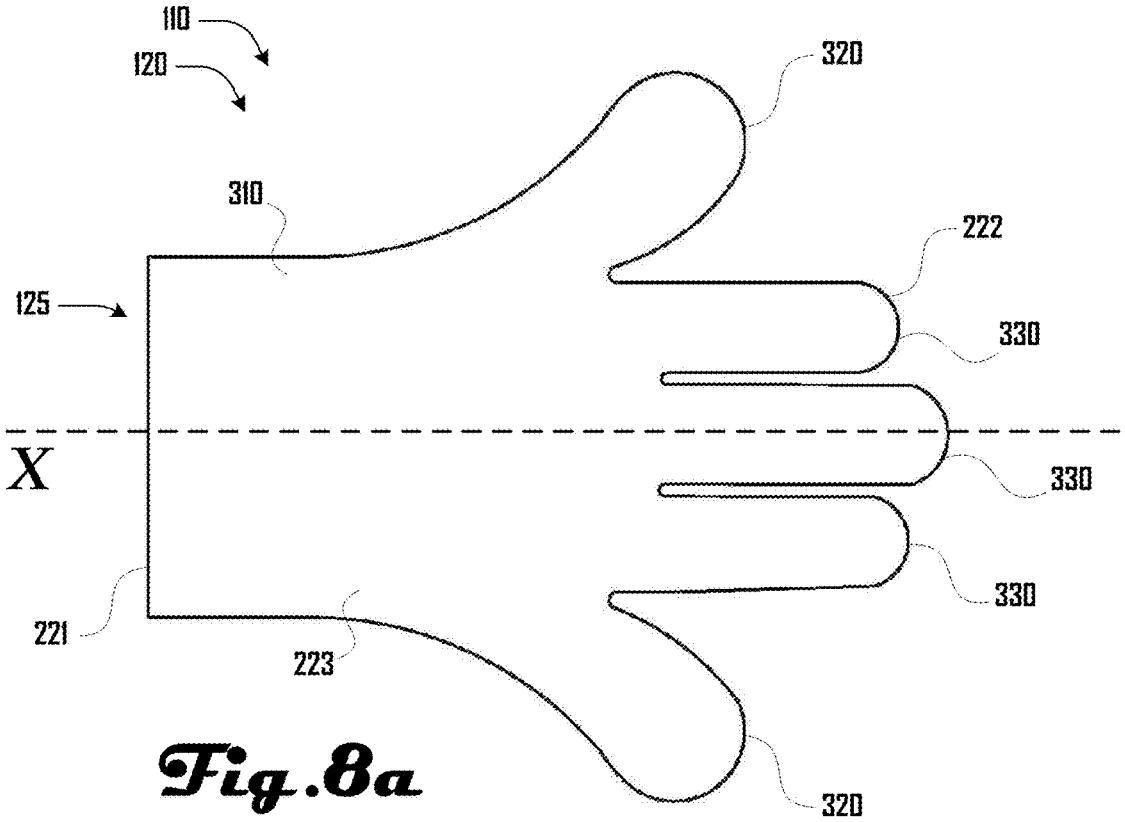
FIGS. 8*a* and 8*b* illustrate example embodiments of a glove body having two thumb portions.
Figure 8B:
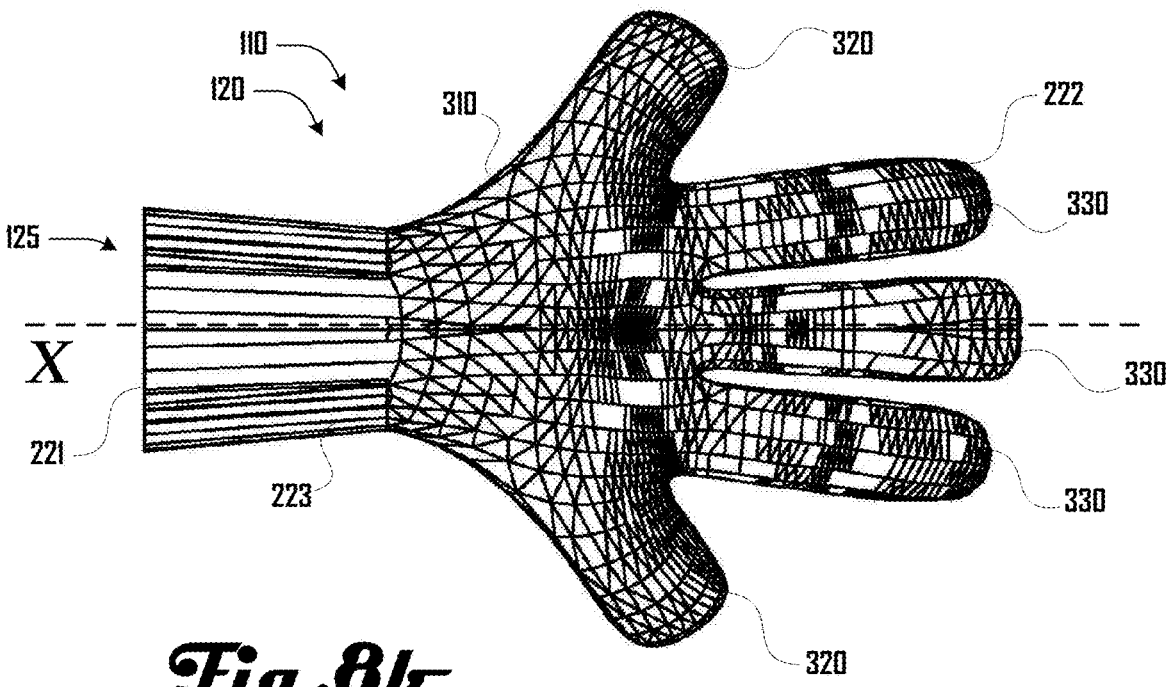

In some examples, glove bodies 120, 130 can comprise a plurality of thumb portions 320. For example, as shown in the example of FIGS. 8*a* and 8*b*, a glove body 120 can comprise two thumb portions 320 on opposing sizes of the glove body 120 with three finger portions 330 disposed between the thumb portions 320. In this example, the glove body 120 has a plane of symmetry X that extends through a middle finger portion 330 that is longer than the two finger portions 330 on opposing sides of the central middle finger portion 330.

Alternative embodiments can comprise two or three finger members configured for one, two or three fingers. For example, one embodiment can include first finger member configured for the index and middle finger of a hand and a second finger member configured for the ring and pinky finger of the hand. Another embodiment can include first finger member configured for the index finger of a hand and a second finger member configured for the middle, ring and pinky finger of the hand.

Additionally, while example embodiments shown herein include glove bodies 120, 130 configured or sized to completely surround all fingers and the thumb of a hand, further embodiments can include one or more glove bodies 120, 130 configured or sized to only partially cover one or more of the thumb and/or fingers of a hand. For example, in some embodiments, the thumb member 320 and/or one or more of the finger members 330 can be truncated or absent, with the second glove body 130 having ports that allow the thumb and/or one or more fingers of a hand to extend out of the second glove body 130 when worn on a hand.

Also, while various preferred embodiments comprise a mirrored first and second glove body 120, 130, in some embodiments, the first and second glove bodies 120, 130 are not mirrored. For example, in one embodiment, the second glove body 130 can comprise a thumb member 320 and four finger members 330 configured to completely surround the five digits of a hand and the first glove body 120 can comprise a first glove cavity 125 defined by a palm portion 310 with truncated and closed thumb and finger members 320, 330. In another example embodiment, the first glove body 120 can have a mitten configuration and the second glove body 130 can have a separate five-digit glove configuration.

As discussed herein, hot air 102 can travel through the duct 150, into the first glove cavity 125, and be expelled from the external face 223 of the first glove body 120. FIGS. 3*a*, 3*b*, 4*a* and 4*b* illustrate several non-limiting examples of structures configured to allow hot air 102 within the first glove cavity 125 to be expelled from the external face 223 of the first glove body 120.

Figure 3A:
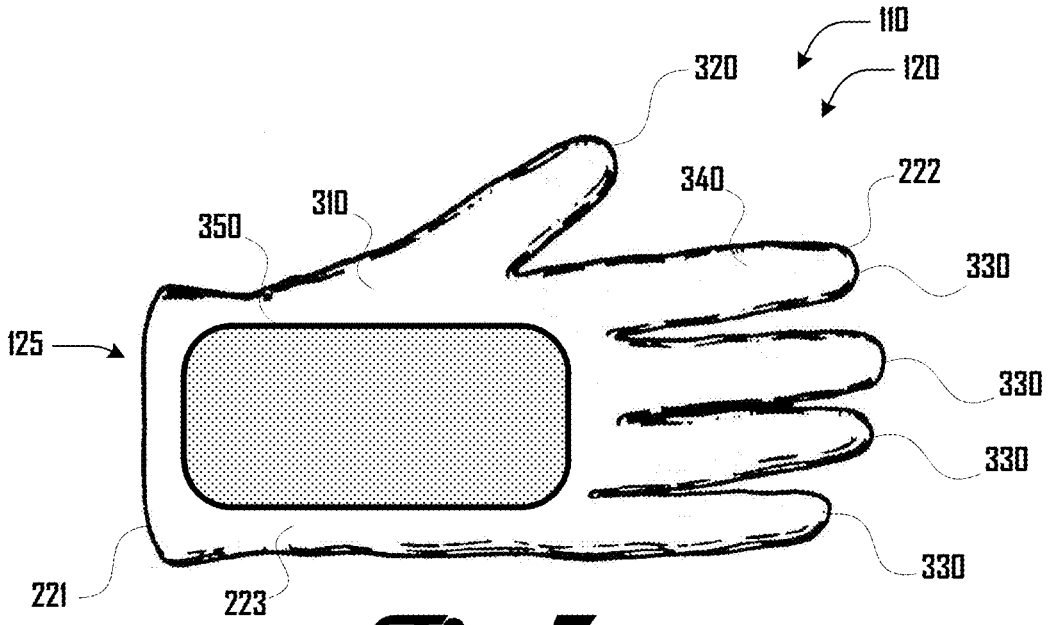
FIGS. 3*a*, 3*b*, 4*a* and 4*b* illustrate exemplary embodiments of a glove body including air-permeable fabric portions or air-ports disposed on an external face of the glove body.
Figure 3B:
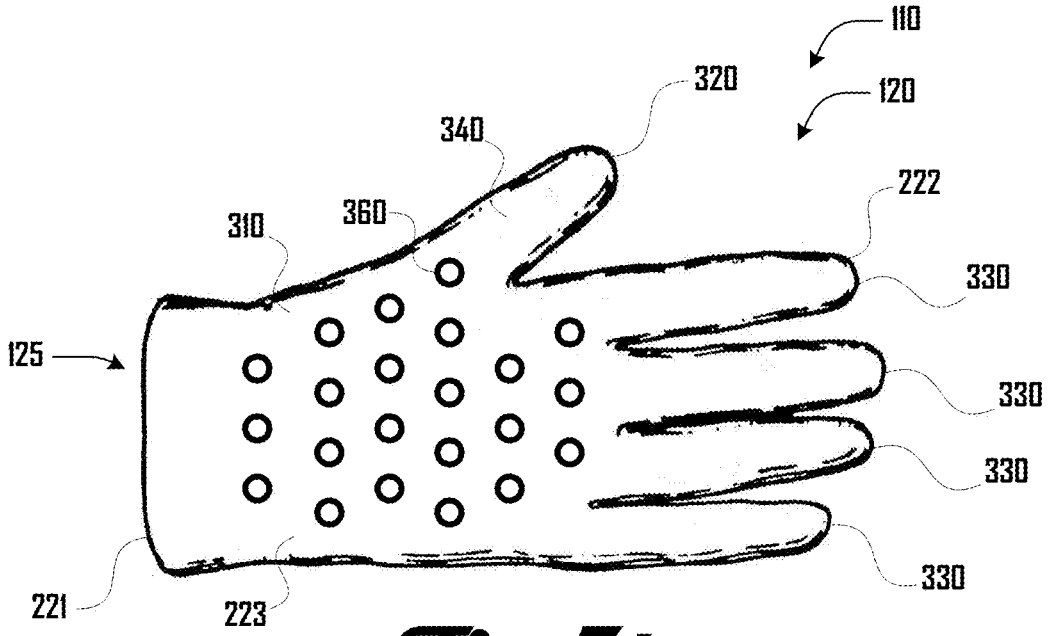

For example, FIG. 3*a* illustrates one embodiment of a first glove body 120 having a non-air-permeable portion 340 and an air-permeable fabric portion 350 disposed on the palm portion 310. FIG. 3*b* illustrates another embodiment of a first glove body 120 having a non-air-permeable portion 340 and air-ports 360 disposed on the palm portion 310.

Figure 4A:
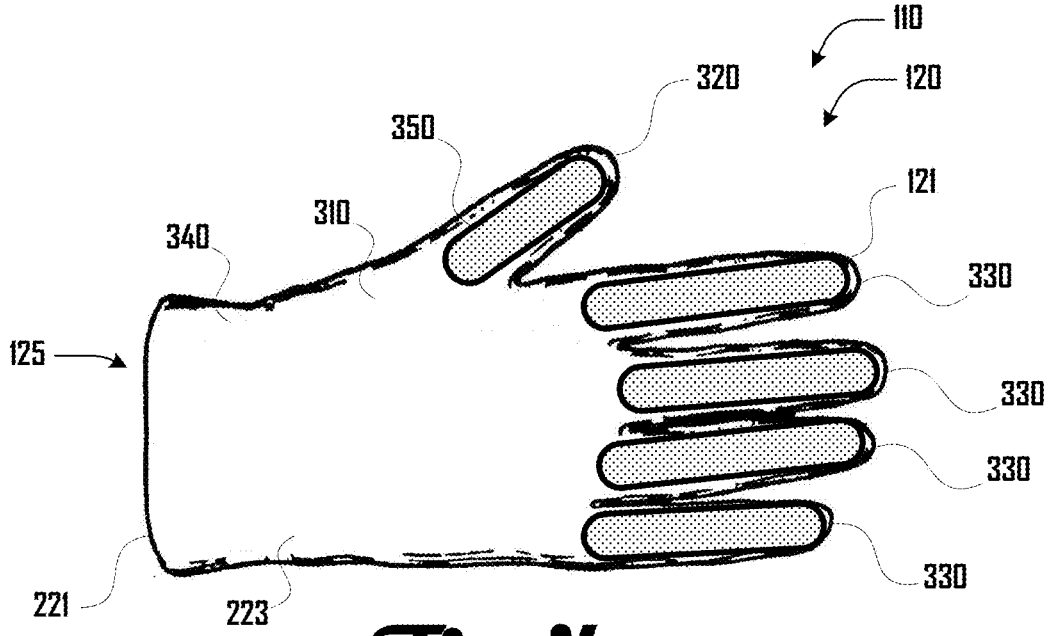
Figure 4B:
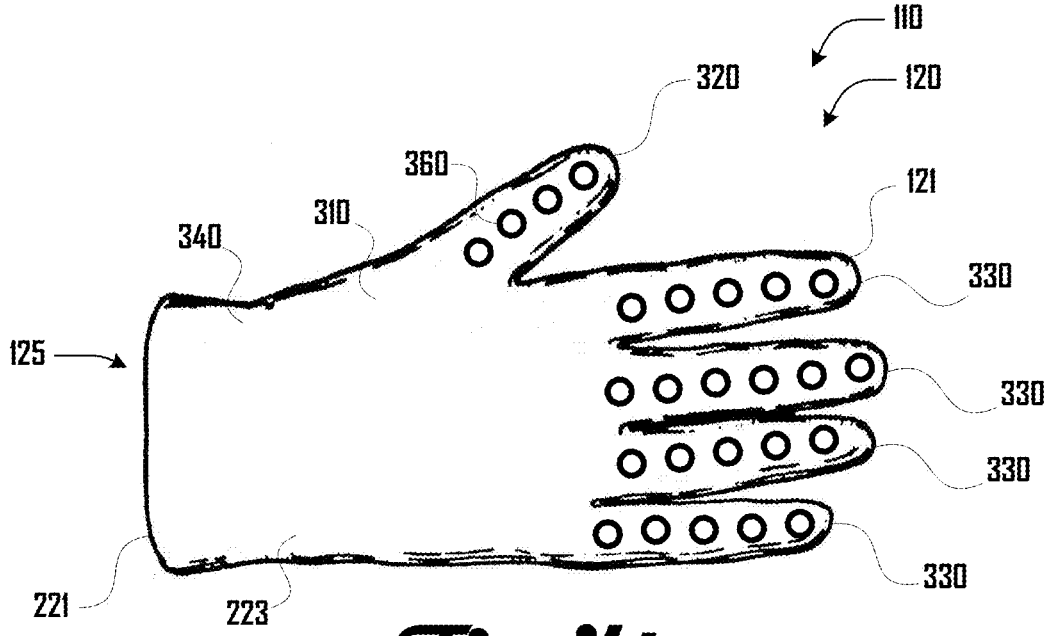

In further examples, FIG. 4*a* illustrates one embodiment of a first glove body 120 having non-air-permeable portions 340 and air-permeable fabric portions 350 disposed on the thumb and finger portions 320, 330. FIG. 4*b* illustrates another embodiment of a first glove body 120 having a non-air-permeable portion 340 and air-ports 360 disposed on the thumb and finger portions 320, 330.

In various embodiments, non-air-permeable portions 340 can be defined by various suitable materials, including a plastic, leather, fabric, rubber, or the like. Such non-air-permeable portions 340 can be rigid or flexible. The air-permeable fabric portion 350 can comprise any suitable fabric, textile, or other material that is air-permeable such that hot air 102 within the first glove cavity 125 can be expelled from the external face 223 of the first glove body 120. For example, in some embodiments, a weave of the air-permeable fabric portion 350 can define gaps that the hot air 102 can pass through.

The air-ports 360 can comprise any suitable structure that defines one or more port in the external face 223 between the first glove cavity 125 and the external environment. Such air-ports 360 can be any suitable size and shape and comprise various suitable structures such as a grommet, nozzle, or the like.

While the examples of air-permeable fabric portions 350 and air-ports 360 shown herein are generally flat and conform to the contours of the external face 223 of the first glove body 120, further examples can comprise structures that substantially extend from the external face 223 of the first glove body 120. Additionally, the example configurations of air-permeable fabric portions 350 and air-ports 360 shown herein should not be construed to be limiting on the wide variety of configurations of such structures that are within the scope and spirit of the present disclosure.

Figure 5:
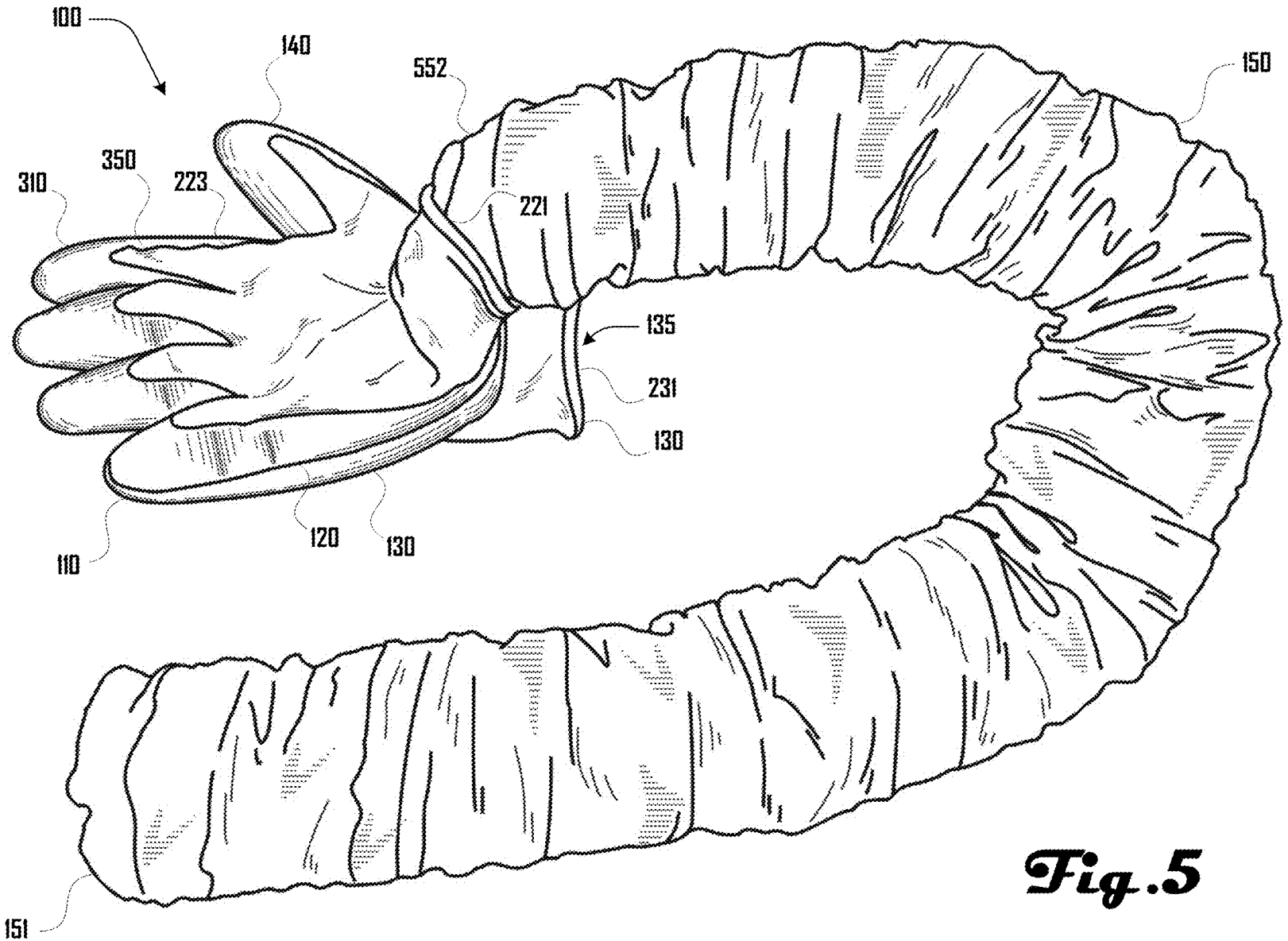
FIG. 5 illustrates an example embodiment of a hair drying system that includes a coil-reinforced duct coupled to a glove assembly.

For example, in further embodiments (e.g., as shown in FIG. 5) an air-permeable fabric portion 350 can contiguously extend from the palm portion 310 to the thumb and finger portions 320, 330 of the first glove body 120, with the air-permeable fabric portion 350 being surrounded by non-air-permeable portions 340 about the edges of the first glove body 120. In various embodiments, having a first glove body 120 with non-air-permeable portions 340 and air-permeable fabric portions 350 and/or air-ports 360 can be desirable because the non-air-permeable portions 340 can direct or limit the flow of hot air 102 out of the external face 223 and control the pressure of the hot air 102 within the first glove cavity 125.

Figure 9:
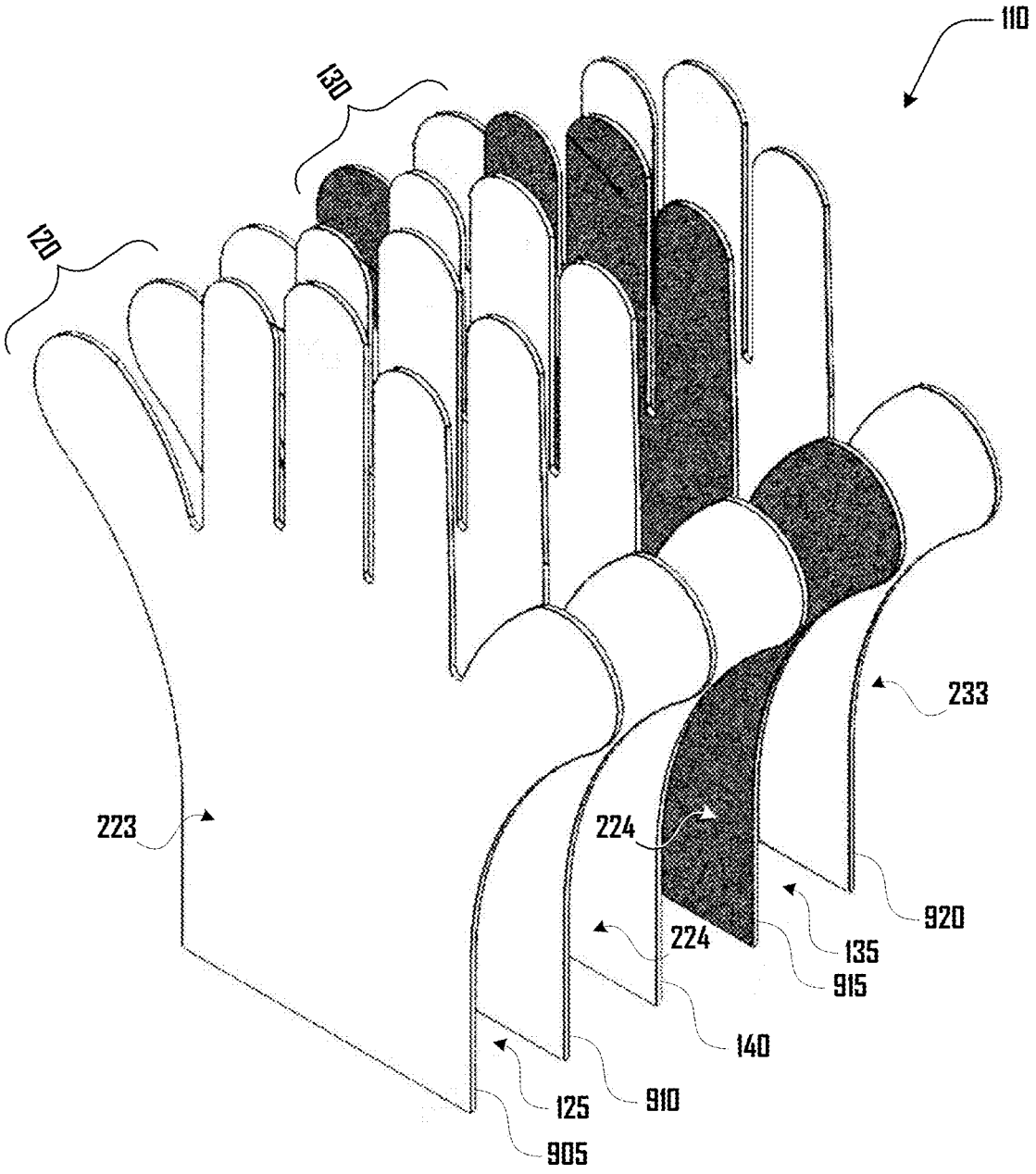
FIG. 9 illustrates an exploded view of example layers of a glove assembly in accordance with one embodiment.

FIG. 9 illustrates an exploded view of an example of a glove assembly 110 comprising a first and second layer 905, 910 that define a first glove body 120 and a third and fourth layer 915, 920 that define a second glove body 130. A seam 140 is disposed between the second and third layers 910, 915. The first and second layers 905, 910 can be coupled together to define a first glove cavity 125. The third and fourth layers 915, 920 can be coupled together to define a second glove cavity 135.

In some embodiments, the first layer 905 can comprise a polyester mesh. In some embodiments, the second layer 910 can comprise a solid polyester sheet. In some embodiments, the seam 140 can comprise a neoprene sheet. In some embodiments, the third layer 915 can comprise a polyester sheet having a vinyl coating on the internal face 234 of the third layer 915 of the second glove body 130. In some embodiments, the fourth layer 920 can comprise a polyester sheet. In further examples, any of the layers 905, 910, 915, 920 or seam 140 can be any suitable material, including the examples discussed above.

FIG. 5 illustrates a further example embodiment of a hair drying system 100 that includes a coil-reinforced duct 150 coupled to a flexible first glove body 120 at a base end 221 of the first glove body 120. A mirroring flexible second glove body 130 is coupled to the first glove body 120 along a seam 140. The first end 151 of the coil-reinforced duct 150 is configured to couple with a blower 160 as described herein.

Figure 6:
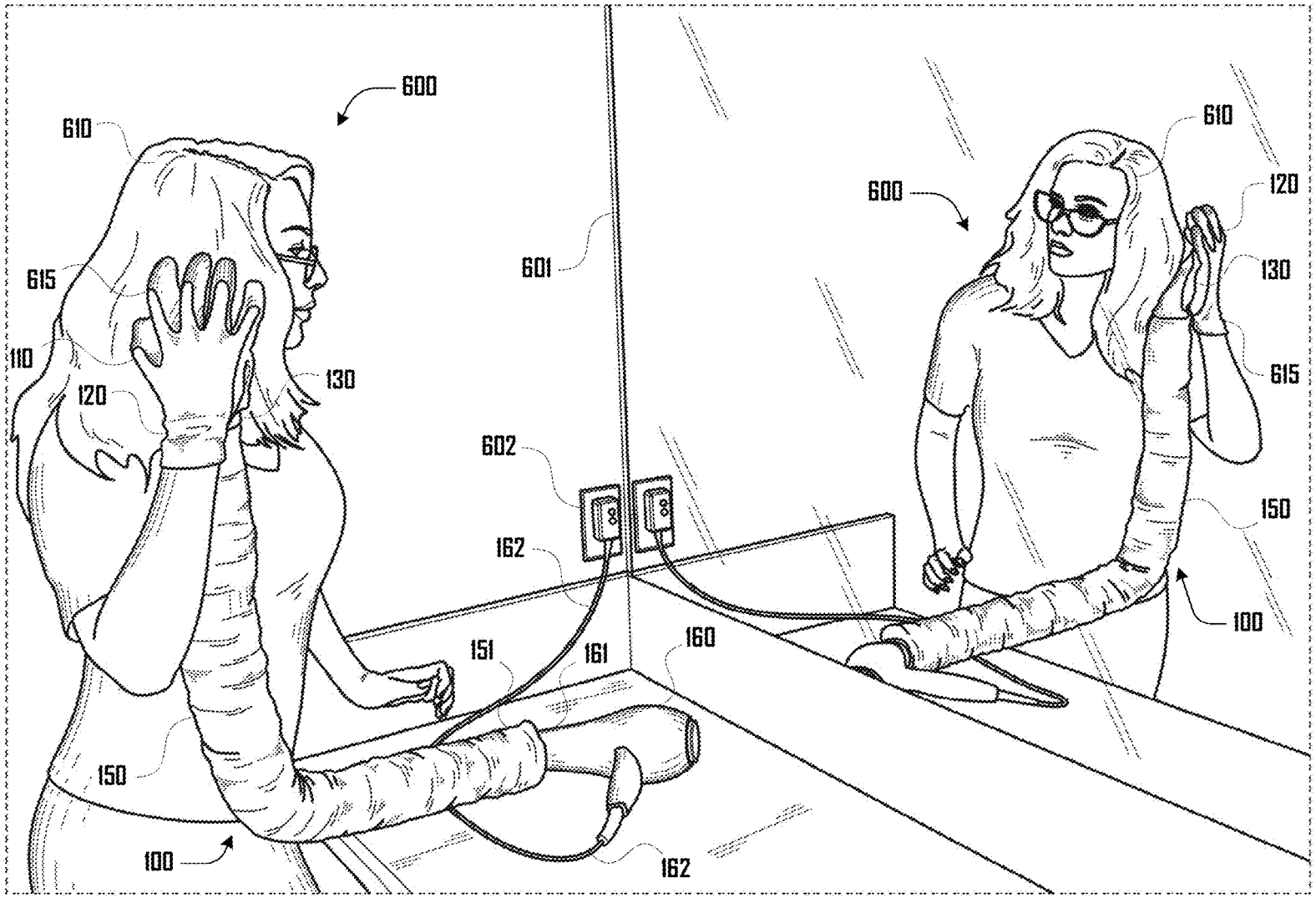
FIG. 6 illustrates an example of a hair drying system being operated by a user to dry her hair in front of a mirror.

FIG. 6 illustrates an example of a hair drying system 100 being operated by a user 600 to dry her hair 610 in front of a mirror 601. As shown in this example, a blower 161 is plugged into a wall receptacle 602 via the blower cord 162, and the blower nozzle 161 is coupled to the duct 150 at the first end 151. The user 600 has her hand 615 disposed within the second glove cavity 135 with the external face 223 of the first glove body 120 facing her hair 610.

As discussed herein, hot air 102 passes from the blower 160, through the duct 150, into the first glove cavity 125, and out the external face 223 of the first glove body 120. The user 600 can manipulate the glove assembly 110 to direct hot air 102 being expelled from the first glove body 120 onto, into and/or about her hair 610. The hot air 102 being expelled from the first glove body 120 can be used to dry, style or otherwise treat the hair 610 of the user 600.

Accordingly, one embodiment of a method of treating hair can including plugging a blower 160 (e.g., a hair dryer) into a wall receptacle 602, coupling the first end 151 of the duct 150 to the nozzle of the blower 160 and inserting the hand 615 of a user 600 into the second glove cavity 135. The method can further include turning on the blower 160 such that the blower generates a flow of hot air 102 that travels through the duct 150, from the first end 151 to the second end 152; into the first glove cavity 125 of the first glove body 120; and out the external face 223 of the first glove body 120 (e.g., via air-permeable fabric portions 350 and/or air-ports 360 disposed on the external face 223). The user 600 can then manipulate the glove assembly 110 with her hand 615 to direct the hot air 102 on her hair 610 to dry her hair 610.

The described embodiments are susceptible to various modifications and alternative forms, and specific examples thereof have been shown by way of example in the drawings and are herein described in detail. It should be understood, however, that the described embodiments are not to be limited to the particular forms or methods disclosed, but to the contrary, the present disclosure is to cover all modifications, equivalents, and alternatives.

What is claimed is:

1. A method of assembling and using a hair drying system comprising:

coupling a nozzle of a hand-held portable commercially available blow dryer with a first end of a duct of a hair drying assembly with the nozzle communicating with a duct cavity defined by the duct, the hair drying assembly comprising:

a glove assembly having:

a first glove body defining a first glove cavity, the first glove body further defining a first palm portion with at least three finger members and at least one thumb portion extending from the first palm portion, the first glove body further defining first glove body internal and external faces and a first glove body opening at a first glove body base end that communicates with the first glove cavity;

a second glove body defining a second glove cavity, the second glove body further defining a second palm portion with at least three finger members and at least one thumb portion extending from the second palm portion, the second glove body further defining second glove body internal and external faces and a second glove body opening at a second glove body base end that communicates with the second glove cavity; and a seam defined by a planar material, the first and second glove body coupled at the first and second glove body internal faces via the seam, with the first and second glove body external faces disposed on opposing sides of an assembled glove body, the first and second glove body coupled with the palm portions, the at least three finger members and at the least one thumb portions of the respective first and second glove body aligned in a mirrored configuration; and an elongated cylindrical duct having a first and second duct end and defining a duct cavity extending between the first and second duct ends, the duct further defining first and second duct openings at the respective first and second duct ends, the second duct end coupled to the first glove body base end with the duct cavity communicating with the first glove body;

plugging an electrical cord of the blow dryer into an electrical wall receptacle to provide electrical power to the blow dryer;

inserting a user hand of a user into the second glove cavity via the second glove body opening with a user thumb disposed in a thumb portion of the second glove body and user fingers disposed within at least three of the finger members of the second glove body;

turning on the blow dryer such that the blow dryer generates a flow of hot air that travels through the duct from the first duct end to the second duct end and into the first glove cavity of the first glove body and out the external face of the first glove body; and manipulating the glove assembly with the user hand disposed in the second glove body to direct the hot air onto the head hair of the user.

2. The method of claim 1, further comprising:

turning off the blow dryer to terminate the flow of hot air;

unplugging the electrical cord of the blow dryer from the electrical wall receptacle; and decoupling the blow dryer from the first end of the duct.

3. A hair drying system comprising:

a glove assembly having:

a first glove body defining a first glove cavity, the first glove body further defining a first palm portion with at least three finger members and at least one thumb portion extending from the first palm portion, the first glove body further defining first glove body internal and external faces and a first glove body opening at a first glove body base end that communicates with the first glove cavity;

a second glove body defining a second glove cavity, the second glove body further defining a second palm portion with at least three finger members and at least one thumb portion extending from the second palm portion, the second glove body further defining second glove body internal and external faces and a second glove body opening at a second glove body base end that communicates with the second glove cavity; and a seam defined by a planar material, the first and second glove body coupled at the first and second glove body internal faces via the seam, with the first and second glove body external faces disposed on opposing sides of an assembled glove body, the first and second glove body coupled with the palm portions, the at least three finger members and the at least one thumb portions of the respective first and second glove body aligned in a mirrored configuration;

an elongated cylindrical duct having a first and second duct end and defining a duct cavity extending between the first and second duct ends, the duct further defining first and second duct openings at the respective first and second duct ends, the second duct end coupled to the first glove body base end with the duct cavity communicating with the first glove body; and a hand-held portable commercially hair dryer having a nozzle, the first end of the duct coupled to the nozzle of the hair dryer with the nozzle communicating with the duct cavity.

4. The hair drying system of claim 3, wherein the glove assembly comprises:

a first and second layer that define the first glove body, the first and second layers coupled together to define the first glove cavity; and a third and fourth layer that define the second glove body, the third and fourth layers coupled together to define the second glove cavity.

5. The hair drying system of claim 4, wherein the first layer comprises a polyester mesh, wherein the second layer comprises a solid polyester sheet, wherein the seam comprises a neoprene sheet, wherein the third layer comprises a polyester sheet having a vinyl coating on the internal face of the second glove body and wherein the fourth layer comprises a solid polyester sheet.

6. The hair drying system of claim 3, wherein the first end of the duct is secured to the blow dryer via a loop strap that encircles a portion of the first end of the duct.

7. The hair drying system of claim 3, wherein the first and second glove bodies each comprise:

a first and second thumb portion on opposing sides of an assembled glove body;

three finger portions disposed between the first and second thumb portions including a middle finger portion and two peripheral finger portions on opposing sides of the middle finger portion, the middle finger portion being longer than the peripheral portions; and a plane of symmetry that extends through the middle finger portion.

8. A drying system comprising:

a glove assembly having:

a first glove body defining a first glove cavity, the first glove body further defining first glove body internal and external faces and a first glove body opening at a first glove body base end that communicates with the first glove cavity;

a second glove body defining a second glove cavity, the second glove body further defining second glove body internal and external faces and a second glove body opening at a second glove body base end that communicates with the second glove cavity; and a seam coupling the first and second glove body; and an elongated duct having a first and second duct end and defining a duct cavity extending between the first and second duct ends, the duct further defining first and second duct openings at the respective first and second duct ends, the second duct end coupled to the first glove body base end with the duct cavity communicating with the first glove body.

9. The drying system of claim 8, wherein the first glove body further defines a first palm portion with at least three finger members and at least one thumb portion extending from the first palm portion, and wherein the second glove body further defines a second palm portion with at least three finger members and at least one thumb portion extending from the second palm portion.

10. The drying system of claim 9, wherein the first and second glove body are coupled at the first and second glove body internal faces via the seam, with the first and second glove body external faces disposed on opposing sides of the glove body, the first and second glove body coupled with the palm portions, at least three finger members and at least one thumb portions of the respective first and second glove body aligned in a mirrored configuration.

11. The drying system of claim 9, wherein the first and second glove bodies each comprise:

a first and second thumb portion on opposing sizes of an assembled glove body; and three finger portions disposed between the first and second thumb portions including a middle finger portion and two peripheral finger portions on opposing sides of the middle finger portion.

12. The drying system of claim 11, wherein the first and second glove bodies each further comprise a plane of symmetry that extends through the middle finger portion.

13. The drying system of claim 8, wherein the seam is defined by a planar material.

14. The drying system of claim 13, wherein the seam comprises a neoprene sheet.

15. The drying system of claim 8, wherein the glove assembly comprises:

a first and second layer that define the first glove body, the first and second layers coupled together to define the first glove cavity; and a third and fourth layer that define the second glove body, the third and fourth layers coupled together to define the second glove cavity.

16. The drying system of claim 15, wherein the first layer comprises a planar mesh material.

17. The drying system of claim 15, wherein the third layer comprises a polyester sheet having a vinyl coating on the internal face of the second glove body.

18. The drying system of claim 8, wherein the first end of the duct is configured to be removably coupled to a nozzle of a hand-held portable commercially hair dryer with the nozzle communicating with the duct cavity.

19. The drying system of claim 18, wherein the first end of the duct a loop strap that encircles a portion of the first end of the duct, the loop strap configured to secure the first end of the duct to the nozzle of the blow dryer.

20. The drying system of claim 8, wherein the duct is coil reinforced with a coil.

* * * * *